United States Patent [19]

Weiss et al.

[11] 4,281,740

[45] Aug. 4, 1981

[54] MUFFLER

[75] Inventors: William R. Weiss, Walnut Creek, Calif.; Lee E. Remy, Colonial Heights, Va.

[73] Assignee: Allied Chemical Corporation, Morris Township, Morris County, N.J.

[21] Appl. No.: 55,729

[22] Filed: Jul. 9, 1979

[51] Int. Cl.[3] ..... F01N 1/04

[52] U.S. Cl. ..... 181/250; 181/252; 181/256

[58] Field of Search ..... 181/200, 212, 224, 229, 181/238, 239, 247-252, 256, 264, 272, 273, 222, 266, 276; 57/305, 1 R, 289

[56] References Cited

U.S. PATENT DOCUMENTS

| | | | |
|---|---|---|---|
| 4,177,629 | 12/1979 | Kennedy | 57/1 R |
| 4,236,597 | 12/1980 | Kiss et al. | 181/256 |

*Primary Examiner*—L. T. Hix
*Assistant Examiner*—Benjamin R. Fuller
*Attorney, Agent, or Firm*—Virginia S. Andrews

[57] ABSTRACT

A muffler (50,50') for use in conjunction with a plurality of aspirators during the production of multifilament, synthetic yarn is provided. The exhaust tubes (32) of the aspirators are clustered for discharge by and through the muffler (50,50') which reduces audible noise collectively emitted at the exit ends of the exhaust tubes (32) by as much as 16 Δ dB(A) and more. The noise is reduced and any waste yarn transported through the use of a plurality of perforated tubes (59,59'), resonant cavities (61,61'), and sound absorbing material (62,62').

13 Claims, 6 Drawing Figures

MUFFLER

BACKGROUND OF THE INVENTION

1. Field of the Invention

This invention relates to a muffler for use during the production of multifilament, synthetic yarn. In particular, it relates to a muffler for use in conjunction with a plurality of aspirators, wherein the exhaust tubes of the aspirators are clustered for discharge by and through the muffler which reduces audible noise collectively emitted at the exit ends of the exhaust tubes by as much as 16 Δ dB(A) and more.

Throughout the present specification and claims, the term "dB(A)" (decibels A-weighted) connotes the unit of measurement of sound level corrected to the A-weighted scale, as defined in ANSI S1.4-1971, using a reference level of 20 micropascals ($2\times10^{-5}$ Newtons per square meter). The term " Δ dB(A)" refers to the difference between the two noise levels where each level is expressed in units of dB(A). The term "yarn" is employed in a general sense to indicate strand material, either textile or otherwise, and including a continuous, often plied, strand composed of fibers, filaments, glass, metal, asbestos, paper, or plastic, or a noncontinuous strand such as staple, and the like. An "end" is one or a contiguous group of such strands of yarn.

The invention is applicable to many phases of yarn handling, the particular use disclosed herein being merely illustrative and not limiting thereof.

2. Prior Art

Aspirators are frequently used in yarn producing processes for transporting yarn. For example, yarn ends thrown through an interfloor tube subsequent to extrusion and quenching may be picked up by an aspirator and carried off to waste until an operator can pick up the yarn end with a handheld aspirator or gun to continue string-up. Also, panel aspirators may be strategically located to aspirate off, when triggered, broken yarn ends to prevent the yarn from snarling or hanging up. Aspirators may also function as temporary collecting devices during the windup stage when starting new packages.

Noise is produced at and downstream of the point at which high velocity air is introduced into the aspirator passageway. The sound waves thus generated are then propagated through the aspirator inlet and outlet ends. U.S. Pat. No. 4,024,698 to Weiss et al., hereby incorporated by reference, teaches a muffler which reduces audible noise emitted at the inlet end of an aspirator by up to 22.5 Δ dB(A). U.S. Pat. No. 4,030,651 to Weiss et al., hereby incorporated by reference, teaches an aspirator exhaust muffler which reduces audible noise emitted at the exit end of an interfloor tube by up to 33.5 Δ dB(A).

The noise travelling through the outlet end of the aspirator passes, along with the aspirated yarn, through exhaust pipes or tubes to a collection point. Given the multiplicity of production positions, each with one or more associated aspirators, normally arranged in rows within a yarn producing plant, it is highly desirable for reasons of cost to have a muffler capable of reducing the noise emitted collectively by the exhaust tubes of the aspirators while simultaneously bringing all of the waste yarn transported thereby to a single collection point. The noise emitted, as measured approximately 6 inches (15.24 cms.) downstream of and on the center line of 16 clustered aspirator exhaust tubes, has been found to exceed 110–112 dB(A) in some instances without use of this invention. The frequency component of exhaust tube noise is situated in the high frequency levels, i.e., greater than 2,000 cycles per second, which has been shown to be more harmful than the low frequency levels.

U.S. Pat. No. 4,127,183 to McLarty is believed to be pertinent art.

SUMMARY OF THE INVENTION

The present invention provides a muffler, preferably for use in conjunction with a plurality of aspirator exhaust tubes during the production of multifilament synthetic yarn.

The essential elements of the muffler are a housing, partition means, a plurality of perforated tubes, and sound absorbing material. The partition means is located within and subdivides the housing into a plurality of discrete chambers. There is one perforated tube per chamber which passes through the chamber to communicate with the exterior of the housing. Each perforated tube forms in conjunction with the partition means and the housing a resonant cavity. Sound absorbing material is disposed throughout each of the resonant cavities.

In a preferred embodiment, a plurality of aspirator exhaust tubes are clustered for discharge by and through a muffler which reduces audible noise collectively emitted at the exit ends of the exhaust tubes by as much as 16 Δ dB(A) and more. The essential elements of the muffler are a boxlike housing, at least one partition, a plurality of perforated tubes, sound absorbing material, and a plurality of imperforate tube extenders. The upstream and downstream faces of the housing each have a plurality of apertures therein, each of the apertures in the upstream face being coaxial with an aperture in the downstream face. The partition(s) are located within and subdivide the housing into a plurality of substantially parallel, discrete chambers bounded at their open ends by the upstream and downstream faces of the housing with one coaxial pair of apertures opening in each of the chambers. There is one perforated tube per chamber which is located within the chamber with its open ends terminating at the upstream and the downstream faces around the coaxial pair of apertures. Each of the perforated tubes has an open area of from 30 to 60 percent, most preferably 40 percent, and the ratio of the length to the inside diameter of each of the perforated tubes is between about 6 to 1 and 12 to 1, most preferably between about 8.64 to 1 and 11.22 to 1. The outside of each of the perforated tubes forms in conjunction with the partitions and the housing a resonant cavity. Sound absorbing material is disposed throughout each of the resonant cavities. Each of the perforated tubes has one of the tube extenders located on the downstream end thereof. The tube extenders have a minimum length equivalent to the diameter of the smallest perforation in the perforated tube. Each aspirator exhaust tube is connected to one of the perforated tubes at the upstream face of the housing. Yarn is transported through the perforated tubes to a collection point.

The invention will be more clearly understood and additional objects and advantages will become apparent upon reference to the discussion below and to the drawings which are given for illustrative purposes.

DETAILED DESCRIPTION OF THE DRAWINGS

Figure 1:
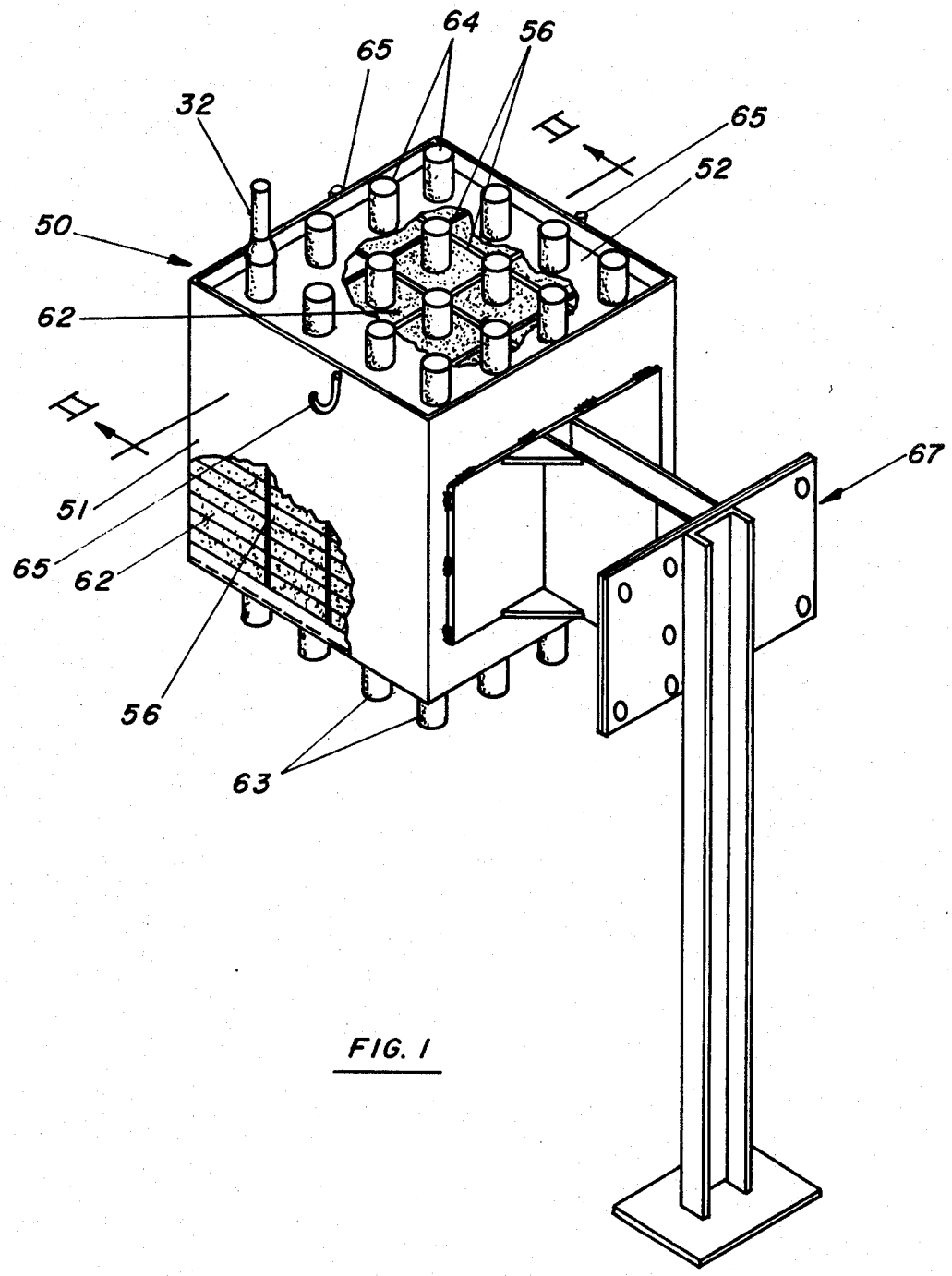
FIG. 1 is an isometric view of a muffler of the present invention.

FIG. 1 of U.S. Pat. No. 4,024,698 to Weiss et al. is an enlarged vertical cross section of an inlet muffler coupled with an aspirator. The drawing shows an exhaust pipe 32 connected to the outlet end of the aspirator through which noise as well as aspirated yarn passes to a yarn waste collection point. The aspirator and exhaust tube depicted in that patent are deemed exemplary, although not exclusive, for purposes of the present invention. For continuity the exhaust tubes in the present invention will also be designated by the numeral 32.

Figure 2:
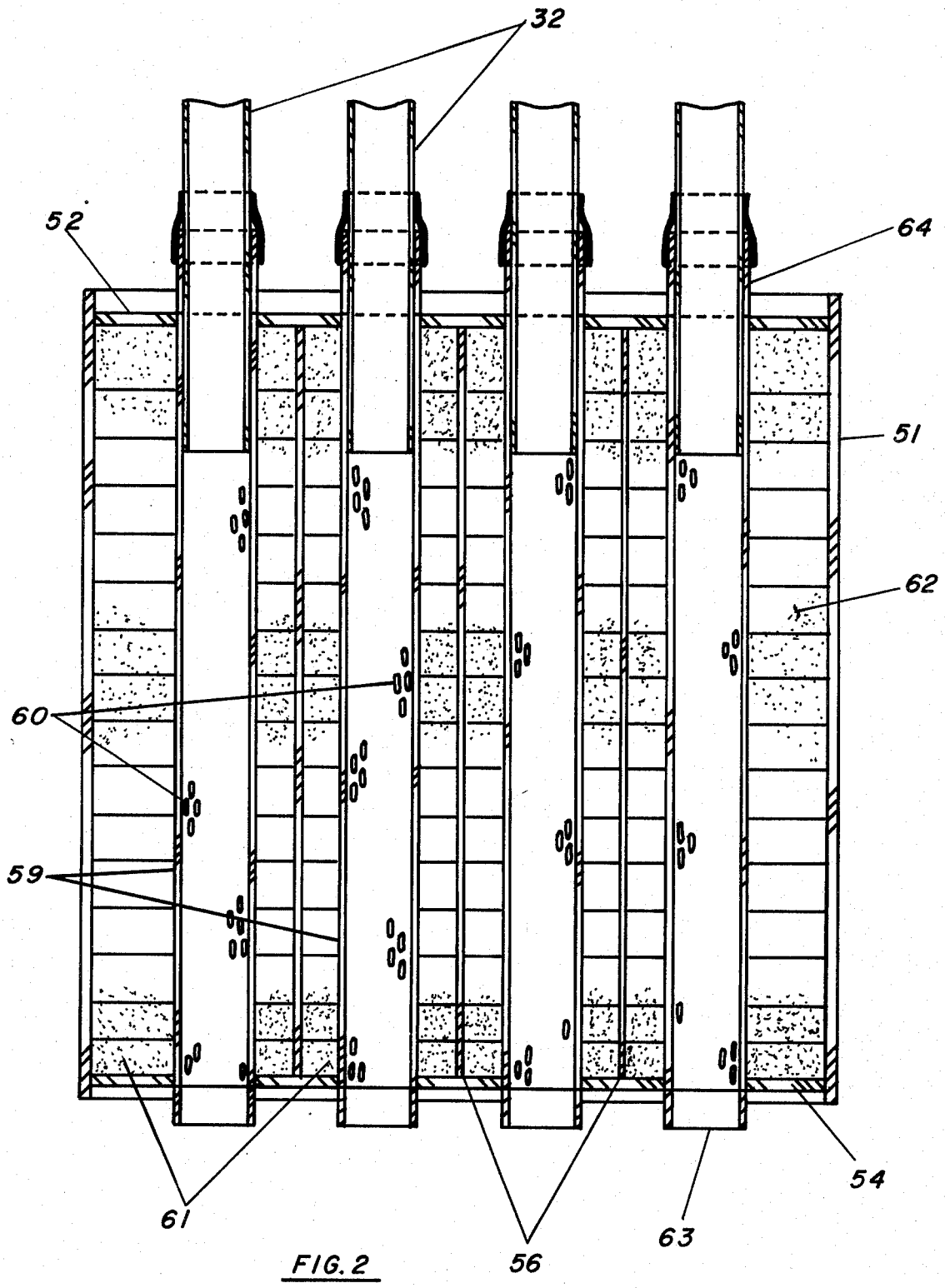
FIG. 2 is a vertical section taken on line II—II of FIG. 1.

In the accompanying drawings, like numbers indicate like apparatus. The muffler of the present invention is designated broadly in FIG. 1 by the numeral 50. FIG. 2 is a cross section at II—II.

Muffler 50 comprises a box-like housing 51, a plurality of partitions 56, a plurality of substantially parallel perforated tubes 59 (see FIG. 2), sound absorbing material 62, and a plurality of imperforate tube extenders 63. Also shown are cover 52, tube extenders 64, support 67, and hooks 65.

In FIG. 2 perforations 60 in tubes 59 are shown, along with housing 51, cover 52, and base 54, tube extenders 63 and 64, exhaust tube 32, partitions 56, and cavity 61.

Figure 3:
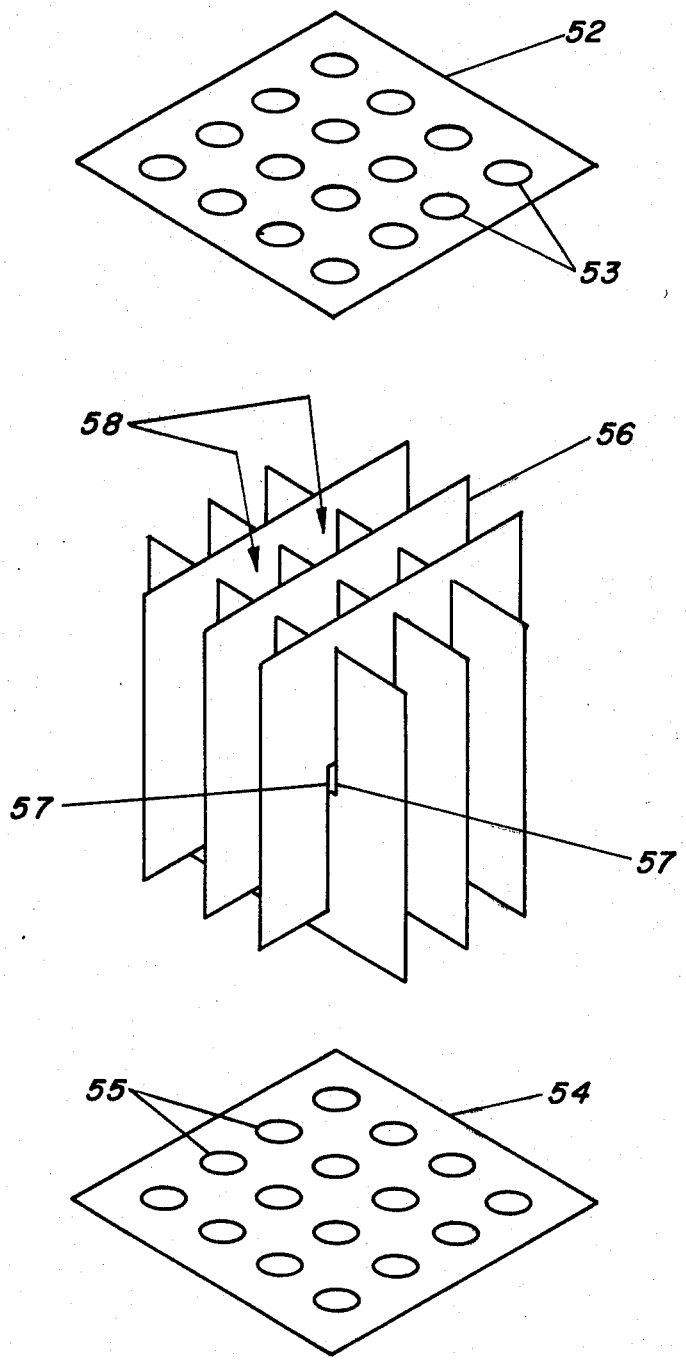
FIG. 3 is an exploded view of the partitions and the upstream and downstream housing faces of FIG. 1.

With reference to FIG. 3, housing 51 has an upstream face or cover 52 with a plurality of apertures 53 therein, and a downstream face or base 54 with a plurality of apertures 55 therein. Each of the apertures 53 in upstream face 52 is coaxial with an aperture 55 in downstream face or base 54.

Partitions 56 are located within and subdivide housing 51 into a plurality of substantially parallel discrete chambers 58 bounded at their open ends by the upstream 52 and downstream 54 faces of housing 51 with a single coaxial pair of apertures 53 and 55 opening on each of chambers 58. With reference to FIG. 3, it can be seen that each partition 56 comprises a sheet having a plurality of parallel slots 57 on one side thereof which extend approximately half the length of the partition. Slots 57 function to permit the interlocking of partitions 56 to form an eggcrate arrangement which has the appearance of a grid in cross section. The slots of the first set of parallel partitions face up while the slots of the second set of parallel partitions, which perpendicularly cross the first set, face down. When all of the partitions 56 are thus assembled, all points of intersection or contact surfaces are sealed, preferably through use of an epoxy or by welding. A seal will likewise be formed at the points of intersection between partitions 56 and housing 51, including upstream 52 and downstream 54 faces.

There is one perforated tube 59 per chamber 58 with the open ends of each perforated tube 59 terminating at upstream 52 and downstream 54 faces around that particular chamber's coaxial pair of apertures 53 and 55. Each perforated tube 59 has a plurality of perforations 60 therethrough which create a total open area of from 30 to 60 percent. Note that the total open area of a perforated tube 59 excludes its two ends. It is preferred that the diameters of the perforations 60 be substantially equal and in the range of from 0.0625 to 0.1875 inch (0.1588 to 0.4763 cm.). It is also preferred that the ratio of the length to the inside diameter of each perforated tube 59 be between about 6 to 1 and 12 to 1, more preferably between about 8.64 to 1 and 11.22 to 1. Each perforated tube 59 forms in conjunction with partitions 56 and housing 51, including upstream 52 and downstream 54 faces, a resonant cavity 61. Sound absorbing material 62 is disposed throughout each resonant cavity.

There is an imperforate tube extender 63 or end ring for each perforated tube 59 which is located on the downstream end of each perforated tube 59. Tube extenders 63 have a minimum length equivalent to the diameter of the smallest perforation 60 in perforated tube 59. While optional, it is also preferred that there be a plurality of imperforate tube extenders 64, one per perforated tube 59, located on the upstream end of each perforated tube 59. Each upstream tube extender 64 is connected to one of exhaust tubes 32 leading from an aspirator. FIG. 1 shows the connection of an exhaust tube 32 to an upstream tube extender 64. It is understood that such a connection exists for each exhaust tube 32. (See also FIG. 2.) It is preferred that exhaust tube 32 be inserted in upstream tube extender 64 and extend a short distance into perforated tube 59. An airtight seal is formed between exhaust tube 32 and tube extender 64 by, for example, wrapping insulation tape around their junction. It is also possible to connect exhaust tube 32 directly to perforated tube 59; in this instance, it is preferred that perforated tube 59 extend for a short distance upstream of housing face 52 and that perforations 60 also be effectively blocked upstream of housing face 52.

In a preferred embodiment, a plurality of spinning positions each utilizes an inlet muffler and aspirator as shown in U.S. Pat. No. 4,024,698 to Weiss et al. The inlet muffler and aspirator are used subsequent to the extrusion and quench stages of a melt-spin process and are positioned such that one or more yarn ends falls freely in a direction substantially perpendicular to the central axis of the inlet muffler. The exhaust tube 32 of each aspirator is connected to an upstream tube extender or end ring 64 of muffler 50. Activation of the aspirator triggers the influx of high velocity air which creates an atmosphere of suction to pull yarn end(s) through, in succession, the inlet muffler, aspirator, exhaust tube 32, and perforated tube 59. Hook 65, mounted on three sides of housing 51, hold a collection bag (not shown) in place downstream of muffler 50 where the waste yarn can collect. A cannister can be conveniently substituted for the collection bag, or additional imperforate exhaust tubes can be connected to downstream tube extenders 63 to carry the waste yarn to a more remote collection receptacle. Support means 67 is provided for suspending muffler 50 above the collection receptacle. It is crucial that chambers 58 be "discrete," i.e., that chambers 58 be incapable of fluid communication with one another, for process reasons. The removal of partitions 56 will result in a pressure loss in perforated tubes 59 (when the aspirators are operational) and the waste yarn will back up to form a plug in its attempt to exit through perforations 60.

Noise travelling with the aspirated yarn through an exhaust tube 32 is muffled as follows. Sound waves issuing from exhaust tube 32 travel into muffler 50 via perforated tube 59 where they are dissipated and attenuated. Each resonant cavity 61 formed by housing 51, upstream 52 and downstream 54 faces, and a perforated tube 59 attenuates the noise by wave reflections and phase mismatching. The sound absorbing material 62 filling each resonant cavity 61 dissipates sound by transforming the acoustical mechanical energy into heat energy, and is the dominant mechanism of high frequency noise reduction.

The volume of each resonant cavity 61, the number of perforations 60 in each tube 59, and the thickness of each tube 59 determines the resonance frequency of each unit of muffler 50. We have found that an open area of between 30 and 60 percent for each tube 59 is preferable when dealing with a frequency component situated in the high frequency levels, i.e., greater than 2,000 cycles per second, as is characteristic of the noise emitted collectively by exhaust tubes 32. If perforated tubes 59 have an open area in excess of 60 percent, the resonance frequency of the muffling units will be lowered, and if perforated tubes 59 have an open area of less than 30 percent, the dissipative effect of the muffling units will decrease.

As indicated, the preferred ratio of the length to the inside diameter of each perforated tube 59 is between about 6 to 1 and 12 to 1. It should be noted, however, that muffler 50 can function outside of this range, albeit with less advantageous results. An increase in the ratio corresponds to an increase in perforated tube 59 length (and chamber 58 length), and results in a larger noise reduction; however, a greater chance of yarn transport problems is introduced. A decrease in the ratio corresponds to a decrease in perforated tube 59 length (and chamber 58 length), and results in a lessening of noise reduction capacity on the part of muffler 50.

Figure 4:
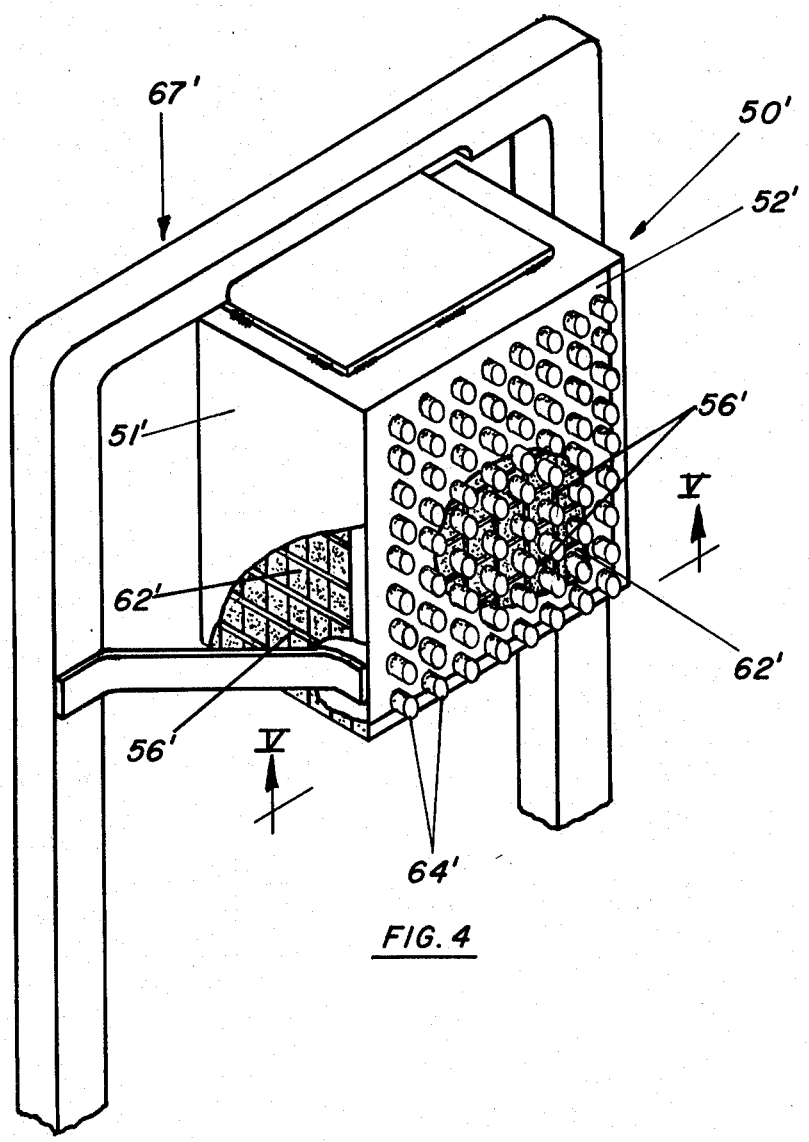
FIG. 4 is an isometric view of a muffler of an alternate embodiment.
Figure 5:
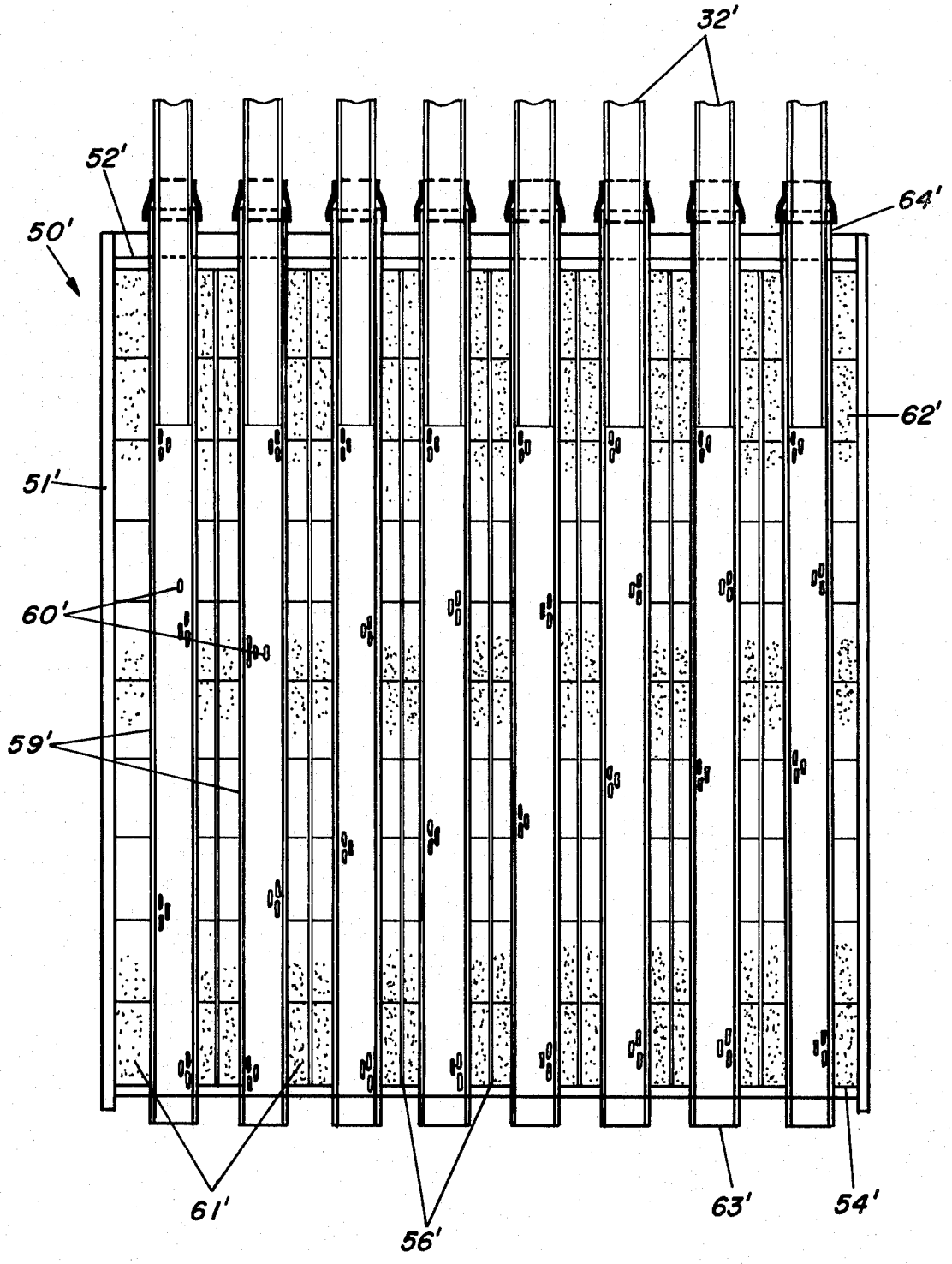
FIG. 5 is a vertical section taken on line V—V of FIG. 4.
Figure 6:
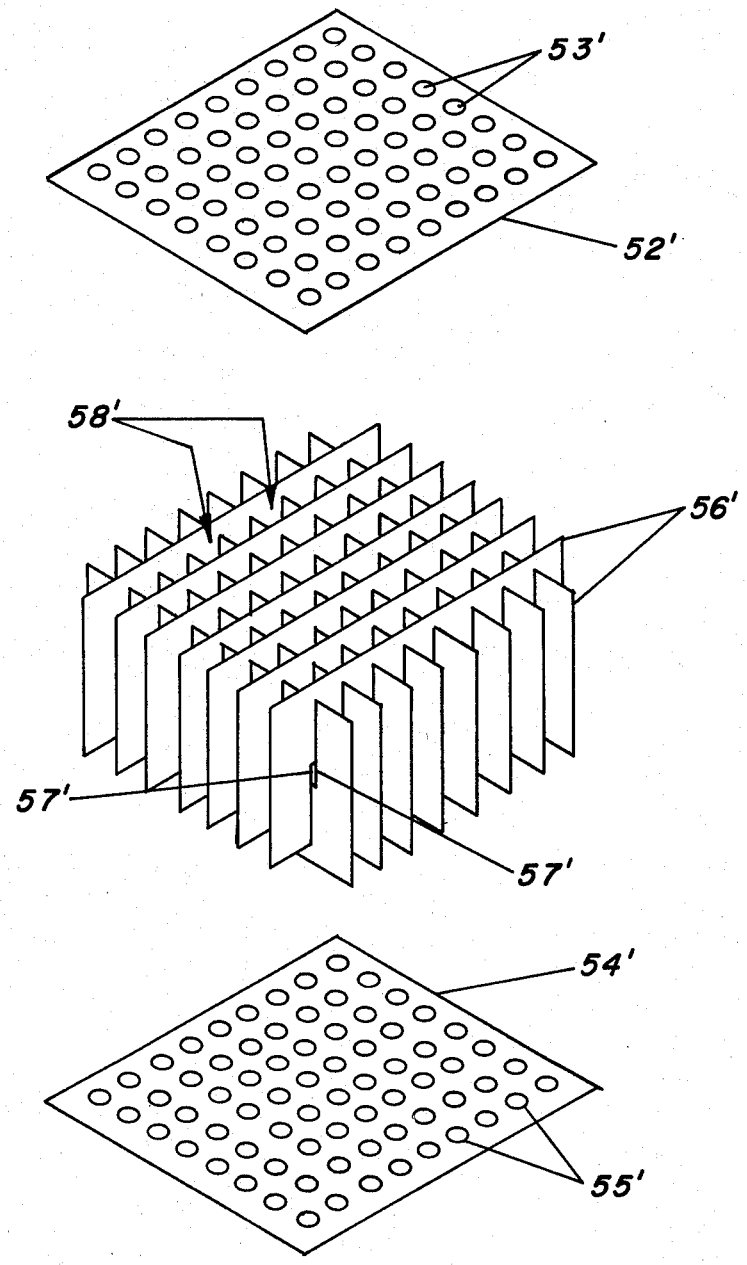
FIG. 6 is an exploded view of the partitions and upstream and downstream housing faces of FIG. 4.

An alternate preferred embodiment is depicted in FIGS. 4–6. Parts similar to those of the embodiment illustrated in FIGS. 1–3 are designated by the same numeral with a prime or accent mark. Muffler 50' is designed to accommodate and muffle the noise collectively emitted by the exhaust tubes 32 of seventy-two draw-wind aspirators.

The materials of construction are preferably as follows: For the sound absorbing material, an open-celled foam, for example, fine pore polyester urethane foam; for the perforated tubes, a metal such as stainless steel; for the exhaust tubes, a plastic; for the screws, carbon steel; and for the other elements a metal such as stainless steel or aluminum, more preferably the latter for reasons of economy.

EXAMPLE 1

Sixteen aspirator exhaust tubes having an outside diameter of about 1.65 inches (4.19 cms.) were clustered to exit collectively to a waste bag. The aspirators (see U.S. Pat. No. 4,024,698) were turned on, and a noise measurement of 110 to 112 dB(A) was obtained using equipment placed approximately 6 inches (15.24 cms.) downstream of and on the center line of the sixteen clustered exhaust tubes. The aspirators were then turned off, and the sixteen exhaust tubes 32 were connected to sixteen tube extenders 64 of a muffler 50, as depicted in FIGS. 1–3, i.e., with six partitions 56 arranged so as to subdivide housing 51 into four rows of four chambers 58 each. The diameters of perforations 60 were approximately 0.125 inch (0.3175 cm.) on 0.1875 inch (0.4763 cm.) staggered center to center rows to create a total open area of approximately 40 percent for each perforated tube 59. The ratio of the length to inside diameter of each tube 59 was approximately 8.64 to 1. End rings or tube extenders 63 and 64 were heliarc welded to, respectively, the downstream and upstream ends of each perforated tube 59, and were sized so as to be flush with both the inside and outside diameters of each perforated tube 59. The upstream tube extenders 64 had a length of approximately 2.75 inches (6.99 cms.), and the downstream tube extenders 63 had a length of approximately 1.5 inches (3.81 cms.). A fine pore polyester urethane foam was utilized as the sound absorbing material 62, more specifically Scottfelt Grade 3-900 manufactured by the Scott Paper Company, Foam Division. Assembly of muffler 50 was as follows. End rings or tube extenders 63 and 64 were heliarc welded to the ends of sixteen perforated tubes 59. Upstream face or cover 52 was installed in housing 51, and downstream face or base 54 was welded to housing 51. The sixteen perforated tubes 59 were welded to upstream face or cover 52. Three hooks 65 were welded to three sides of housing 51. Assembled support means 67 was welded to the non-hook side of housing 51. Upstream face 52 was removed from housing 51, and partitions 56 were installed on upstream face 52. Fourteen one inch (2.54 cms.) thick rectangles of sound absorbing material 62, each having a hole therethrough to permit its being slipped onto perforated tube 59, were stacked in each chamber with a perforated tube 59 passing therethrough. Upstream face 52 was then reinstalled in housing 51. A support strip was installed along the juncture of upstream face 52 and housing 51.

The sixteen aspirators were again turned on, and a noise measurement of 94 dB(A) was obtained using equipment placed approximately 6 inches (15.24 cms.) downstream of and on the center line of muffler 50. This represents a noise reduction of approximately 16 to 18 Δ dB(A). While is is possible that all sixteen aspirators could be simultaneously in operation, it is more likely that only a few will be in operation at a given time due to the nature of the function being served by the aspirators.

EXAMPLE 2

Sixteen panel aspirator exhaust tubes 32 having an outside diameter of about 1.025 inches (2.604 cms.) are connected to sixteen tube extenders 64 of a muffler 50 as depicted in FIGS. 1–3, i.e., with six partitions 56 arranged so as to subdivide housing 51 into four rows of four chambers 58 each. The diameters of perforations 60 are approximately 0.125 inch (0.3175 cm.) on 0.1875 inch (0.4763 cm.) staggered center to center rows to create a total open area of approximately 40 percent for each perforated tube 59. The ratio of the length to inside diameter of each tube 59 is approximately 11.22 to 1. End rings or tube extenders 63 and 64 are heliarc welded to, respectively, the downstream and upstream ends of each perforated tube 59, and are sized so as to be flush with both the inside and outside diameters of each perforated tube 59. The upstream tube extenders 64 have a length of approximately 2.25 inches (5.72 cms.), and the downstream tube extenders 63 have a length of about 0.75 inch (1.91 cms.). A fine pore polyester urethane foam is utilized as the sound absorbing material 62, more specifically Scottfelt Grade 3-900 manufactured by the Scott Paper Company, Foam Division. Assembly of muffler 50 is as follows. End rings or tube extenders 63 and 64 are heliarc welded to the ends of sixteen perforated tubes 59. Upstream face or cover 52 is installed in housing 51, and downstream face or base 54 is welded to housing 51. The sixteen perforated tubes 59 are welded to upstream face or cover 52. Three hooks 65 are welded to three sides of housing 51. Assembled support means 67 is welded to the non-hook side of housing 51. Upstream face 52 is removed from housing 51, and partitions 56 are installed on upstream face 52. Eleven one inch (2.54 cms.) thick rectangles of sound absorbing material 62, each having a hole therethrough to permit its being slipped onto perforated tube 59, are stacked in each chamber with a perforated tube 59 passing therethrough. Upstream face 52 is then reinstalled in housing 51. A support strip is installed along the juncture of upstream face 52 and housing 51.

Muffler 50 is effective in reducing the noise collectively emitted at the exit ends of the sixteen panel aspirator exhaust tubes.

EXAMPLE 3

Seventy-two draw-wind aspirator exhaust tubes 32 having an outside diameter of about 0.6865 inch (1.744 cms.) are connected to seventy-two tube extenders 64' of a muffler 50' as depicted in FIGS. 4–6, i.e., with fifteen partitions 56' arranged so as to subdivide housing 51' into eight rows of nine chambers 58' each. The diameters of perforations 60' are approximately 0.125 inch (0.3175 cm.) on 0.1875 inch (0.4763 cm.) staggered center to center rows to create a total open area of approximately 40 percent for each perforated tube 50'. The ratio of the length to inside diameter of each tube 59' is approximately 10.92 to 1. End rings or tube extenders 63' and 64' are heliarc welded to, respectively, the downstream and upstream ends of each perforated tube 59', and are sized so as to be flush with both the inside and outside diameters of each perforated tube 59'. The upstream tube extenders 64' have a length of approximately 2.25 inches (5.72 cms.), and the downstream tube extenders 63' have a length of about 0.75 inch (1.91 cms.). A fine pore polyester urethane foam is utilized as the sound absorbing material 62', more specifically Scottfelt Grade 3-900 manufactured by the Scott Paper Company, Foam Division. Assembly of muffler 50' is as follows. End rings or tube extenders 63' and 64' are heliarc welded to the ends of seventy-two perforated tubes 59'. Upstream face or cover 52' is installed in housing 51', and downstream face or base 54' is welded to housing 51'. The seventy-two perforated tubes 59' are welded to the upstream face 52'. Upstream face 52' is removed from housing 51', and partitions 56' are installed on upstream face 52'. Seven one inch (2.54 cms.) thick rectangles of sound absorbing material 62', each having a hole therethrough to permit its being slipped onto perforated tube 59', are stacked in each chamber with a perforated tube 59' passing therethrough. Upstream face 52' is then reinstalled in housing 51'. A mounting bracket is welded to housing 51' in order to permit attachment to support means 67'.

Muffler 50' is effective in reducing the noise collectively emitted at the exit ends of the seventy-two draw-wind aspirator exhaust tubes.

Examples 1 through 3 above illustrate the preferred apparatus of the present invention and are not to be considered limiting of the invention in any means. For instance, while the examples show sound absorbing material 62, 62' as rectangles of Scottfelt Grade 3-900 foam, an alternate but equally acceptable approach would be to wrap a layer of Scottfelt Grade 3-900 foam around perforated tube 59, 59' and squeeze the assembly into chamber 58, 58'. The only requirement is that cavity 61,61' be filled with sound absorbing material 62, 62'. Various modifications and other advantages will be apparent to one skilled in the art, and it is intended that this invention be limited only as set forth in the following claims.

It is claimed:

1. A muffler for use in conjunction with a plurality of aspirator exhaust tubes during the production of multifilament synthetic yarn, said muffler comprising:

a. a housing;

b. a partition located within and subdividing said housing into a plurality of discrete chambers;

c. a plurality of perforated tubes through which the yarn travels, one per said chamber, which passes through said chamber to communicate with the exterior or said housing, each of said tubes forming in conjunction with said partition and said housing a resonant cavity; and d. sound absorbing material disposed throughout each of said resonant cavities.

2. The muffler of claim 1 wherein each of said perforated tubes has an open area of from 30 to 60 percent.

3. The muffler of claim 1 wherein the ratio of the length to the inside diameter of each of said perforated tubes is between about 6 to 1 and 12 to 1.

4. The muffler of claim 1 wherein each of the upstream and downstream faces of said housing has a plurality of apertures therein, the number of said apertures per face being the same, each of said chambers being bounded at their upstream and downstream ends by, respectively, the upstream and downstream faces of said housing with one of said apertures per face per said chamber, each of said perforated tubes passing through one of said chambers terminating at the upstream and downstream faces around one of said apertures per face per said chamber.

5. The muffler of claim 4 wherein each of said apertures in the upstream face is coaxial with one of said apertures in the downstream face, one coaxial pair of said apertures opening on each of said chambers.

6. The muffler of claim 1 wherein said sound absorbing material is a fine pore polyester urethane foam.

7. The muffler of claim 1 wherein said muffler further comprises a plurality of imperforate tube extenders, each of said perforated tubes having one of said tube extenders located on the downstream end thereof, said tube extenders having a minimum length equivalent to the diameter of the smallest perforation in said perforated tube; and wherein each aspirator exhaust tube is connected to one of said perforated tubes at the upstream face of said housing.

8. The muffler of claim 7 wherein each of said perforated tubes also has one of said tube extenders located on the upstream end thereof for connection with one of the aspirator exhaust tubes.

9. A muffler for use in conjunction with a plurality of aspirator exhaust tubes during the production of multifilament synthetic yarn, said muffler comprising:

a. a boxlike housing, the upstream and downstream faces of said housing each having a plurality of apertures therein, each of said apertures in the upstream face being coaxial with one of said apertures in the downstream face;

b. at least one partition, located within and subdividing said housing into a plurality of substantially parallel discrete chambers bounded at their open ends by the upstream and downstream faces of said housing with one coaxial pair of said apertures opening on each of said chambers;

c. a plurality of perforated tubes, one per said chamber, which is located within said chamber with the open ends of said perforated tube terminating at the upstream and the downstream faces around said coaxial pair of said apertures, each of said perforated tubes having an open area of from 30 to 60 percent, the ratio of the length to the inside diameter of each of said perforated tubes being between about 6 to 1 and 12 to 1, the outside of each of said perforated tubes forming in conjunction with said partitions and said housing a resonant cavity;

d. sound absorbing material disposed throughout each of said resonant cavities; and e. a plurality of imperforate tube extenders, each of said perforated tubes having one of said tube extenders located on the downstream end thereof, said tube extenders having a minimum length equivalent to the diameter of the smallest perforation in said perforated tube;

whereby each aspirator exhaust tube is connected to one of said perforated tubes at the upstream face of said housing to thereby reduce by as much as 16 $\Delta$ dB(A) and more audible noise collectively emitted at the exit end of the exhaust tubes, and whereby yarn can be transported through said perforated tubes to a collection point.

10. The muffler of claim 9 wherein each of said perforated tubes also has one of said tube extenders located on the upstream end thereof for connection with one of the aspirator exhaust tubes.

11. The muffler of claim 9 wherein said sound absorbing material is a fine pore polyester urethane foam.

12. The muffler of claim 9 wherein the diameters of said perforations are approximately 0.125 inch (0.3175 cms.), to create an open area of approximately 40 percent for each of said perforated tubes.

13. The muffler of claim 9 wherein said ratio of the length to the inside diameter of each of said perforated tubes is between about 8.64 to 1 and 11.22 to 1.

* * * * *

UNITED STATES PATENT AND TRADEMARK OFFICE

CERTIFICATE OF CORRECTION

PATENT NO. : 4,281,740

DATED : August 4, 1981

INVENTOR(S) : William R. Weiss and Lee E. Remy

It is certified that error appears in the above-identified patent and that said Letters Patent are hereby corrected as shown below:

Column 8, line 26, "or said housing" should read --of said housing--.

Signed and Sealed this

Tenth Day of November 1981

[SEAL]

*Attest:*

GERALD J. MOSSINGHOFF

*Attesting Officer*

*Commissioner of Patents and Trademarks*